US005230318A

United States Patent [19]

Iwamoto

[11] Patent Number: 5,230,318

[45] Date of Patent: Jul. 27, 1993

[54] FUEL SUPPLY CONTROL APPARATUS FOR INTERNAL COMBUSTION ENGINE

[75] Inventor: Shinichi Iwamoto, Oobu, Japan

[73] Assignee: Nippondenso Co., Ltd., Kariya, Japan

[21] Appl. No.: 895,811

[22] Filed: Jun. 9, 1992

[30] Foreign Application Priority Data

Jun. 13, 1991 [JP] Japan ..... 3-141775

[51] Int. Cl.[5] ..... F02D 41/04

[52] U.S. Cl. ..... 123/478; 123/492

[58] Field of Search ..... 123/478, 480, 492; 364/431.05

[56] References Cited

U.S. PATENT DOCUMENTS 4,413,601 11/1983 Matsuoka et al. ..... 123/480
4,596,164 6/1986 Hasegawa et al. ..... 123/480
4,655,186 4/1987 Takeda et al. ..... 123/492 X
4,662,340 5/1987 Nagano ..... 123/492

FOREIGN PATENT DOCUMENTS 61-207857 9/1986 Japan .
1-277631 11/1989 Japan .

*Primary Examiner*—Tony M. Argenbright
*Attorney, Agent, or Firm*—Cushman, Darby & Cushman

[57] ABSTRACT

A fuel supply control apparatus for an internal combustion engine on a motor vehicle which controls the fuel injection quantity to the engine in accordance with an operating state of the engine, the apparatus detects a gear-shift position in a transmission of the engine on the basis of an engine speed and a vehicle speed so as to set a pressure decision value on the basis of the gear-shift position and the vehicle speed. This pressure decision value is compared with the actual intake pipe pressure so that the decision is made such that the engine is in a high-load state when the intake pipe pressure is higher than the pressure decision value. The apparatus increases the fuel injection quantity to the engine under the decision that the engine is in the high-load state. This arrangement can accurately detects the engine high-load state so as to ensure the effective travelling of the motor vehicle.

6 Claims, 6 Drawing Sheets

FUEL SUPPLY CONTROL APPARATUS FOR INTERNAL COMBUSTION ENGINE

BACKGROUND OF THE INVENTION

The present invention relates to a fuel supply control apparatus for an internal combustion engine which controls the supply quantity of fuel into a combustion chamber of the engine.

Conventionally, as a means for electronically controlling the fuel supply quantity into a combustion chamber of an internal combustion engine on the basis of the state of the engine and the travelling state of the motor vehicle, there is known an apparatus which detects the state of the engine to increase the fuel supply quantity into the combustion chamber when the engine takes a high-load state. For example, the decision as to whether or not the engine takes the high-load state is made on the basis of the degree of the pressure within the intake pipe without using a throttle valve opening sensor. More specifically, a decision level for deciding the high-load state is set on the basis of the speed of the engine so as to be compared with the intake pipe pressure so that the high-load state is determined when the intake pipe pressure exceeds the decision level (for example, as disclosed in the Japanese Patent provisional Publication No. 1-277631). There is a problem which arises with such a technique, however, in that, in the case that the motor vehicle is running at a highland or in other cases, the intake pipe pressure is affected by the atmospheric pressure so that the intake pipe pressure does not become above the decision level irrespective of the engine taking the high-load state, whereby difficulty is encountered to obtain a sufficient output from the engine.

One possible solution is that an atmospheric-pressure sensor is provided to correct the intake pipe pressure on the basis of the detection result of the atmospheric-pressure sensor. However, this technique also provides a problem that the apparatus becomes complicated because of additionally providing a new sensor. Further, as disclosed in the Japanese Patent provisional Publication No. 61-207857, there is known a technique where the gear position of the transmission is detected so that, when the actual engine speed is higher than a predetermined value sit in correspondence with each of the gear positions, the decision is made such that the throttle valve is in the fully opening state, and in this time the detection value of the intake pipe pressure sensor is read as the atmospheric pressure so as to correct the decision level on the basis of the read atmospheric pressure to compare the corrected decision level with the intake pipe pressure to check whether the engine is in the high-load state. However, for example, in the case that the motor vehicle is going down a slope, this technique also has a problem. That is, when the engine speed gradually increases to exceed a predetermined value irrespective of the throttle valve being in the half-opening or slightly opening state, the decision is made in error such that the throttle valve is in the fully opening state, whereby there is the possibility that at this time the intake pipe pressure is read as the atmospheric pressure in accordance with the error decision to make it difficult to accurately decide the high-load state of the engine. Further, in the case that the motor vehicle is going up a slope, there is the possibility that, irrespective of the throttle valve taking the fully opening state, the high-load decision is not made because the engine speed scarcely increases.

SUMMARY OF THE INVENTION

It is therefore an object of the present invention to provide a fuel supply control apparatus for an internal combustion engine which is capable of accurately detecting the high-load state of the engine to effectively supply fuel into the engine.

A fuel supply control apparatus according to this invention detects the speed of the motor vehicle and the rotational speed of the engine so as to detect a gear-shift state in a transmission of the engine and further sets an intake pipe pressure decision value on the basis of the vehicle speed and the gear-shift position. The set pressure decision value is compared with the actual intake pipe pressure so as to decide that the engine is in a high-load state when the actual intake pipe pressure is higher than the pressure decision value. The apparatus increases the fuel injection quantity to the engine in accordance with the engine high-load state decision.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
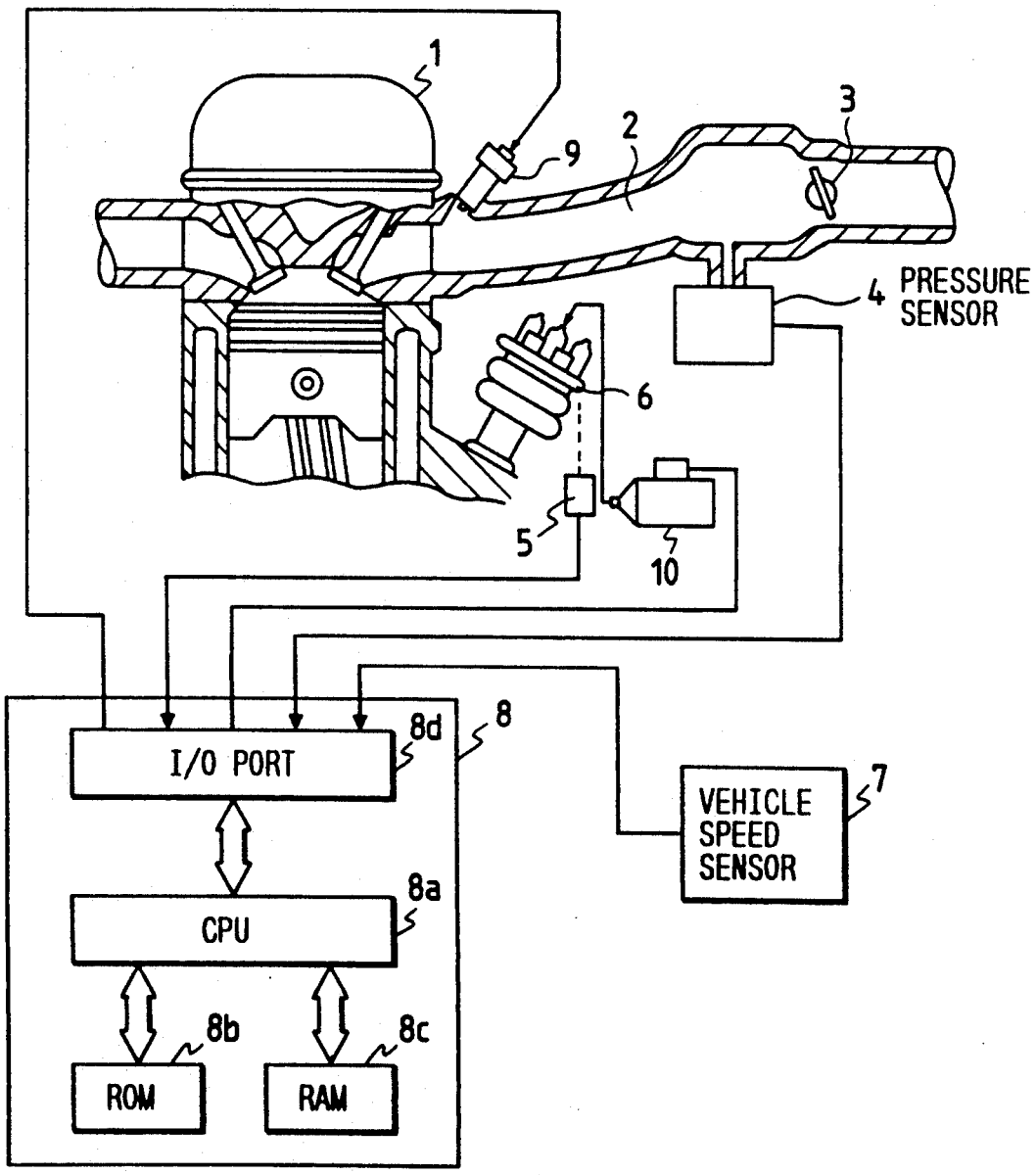
FIG. 1 shows the entire arrangement of a fuel supply control apparatus according to the present invention.

FIG. 1 shows an arrangement of a fuel supply control apparatus according to an embodiment of the present invention which is applied to an internal combustion engine. In FIG. 1, designated at numeral 1 is an internal combustion engine connected to an intake pipe 2 for introducing air from an air cleaner into the the engine 1. In the intake pipe 2 there is provided a throttle valve 3 which is openable and closable in connection with an acceleration pedal (not shown) to control the air quantity to be sucked. Further, in relation to the intake pipe 2 there is provided a pressure sensor 4 for detecting the pressure within the intake pipe 2 to output a detection signal to an electronic control unit 8 which will be described hereinafter. Numeral 5 designates a rotational angle sensor which is encased within a distributor 6 to output a signal at every predetermined crank angle to obtain the rotational speed (engine speed) Ne of the engine 1. The detection signal of the rotational angle sensor 5 is also supplied to the electronic control unit 8.

Numeral 7 represents a vehicle speed sensor for detecting the speed of the motor vehicle on the basis of the rotation of a speed meter cable (not shown) of the motor vehicle. Similarly, the detection signal of the vehicle speed sensor is inputted to the electronic control unit 8.

The electronic control unit (which will be referred hereinafter to as ECU) 8 is for calculating the optimal control amounts for the fuel system and the ignition system on the basis of the detection signals from the aforementioned sensors and other sensors and outputs control signals in accordance with the calculation results to adequately control an injector 9, an igniter 10 and others. The ECU 8 comprises a well-known CPU (central processing unit) 8*a* for performing the calculation operations, a ROM (read-only memory) 8*b* for storing the control programs and control constants necessary for the calculations, a RAM (random access memory) 8*c* for temporarily storing the calculation data during operation of the CPU 8*a*, and an I/O port 8*d* for outputting signals to external devices and for inputting signals from external devices. In addition, the ECU 8 acts as a gear-shift state detecting means for detecting the gear-shifted state (gear-shift position) in the transmission of the motor vehicle on the basis of the information from the rotational angle sensor 5 and the vehicle speed sensor 7, acts as a pressure decision value setting means to set a pressure decision value on the basis of the gear-shift state and the information from the vehicle speed sensor 7, and further acts as a high-load decision means to decide, on the basis of the detection signal of the pressure sensor 4 and the pressure decision value in accordance with an operation (which will be described hereinafter), whether the engine 1 is in a high-load state.

Figure 2:
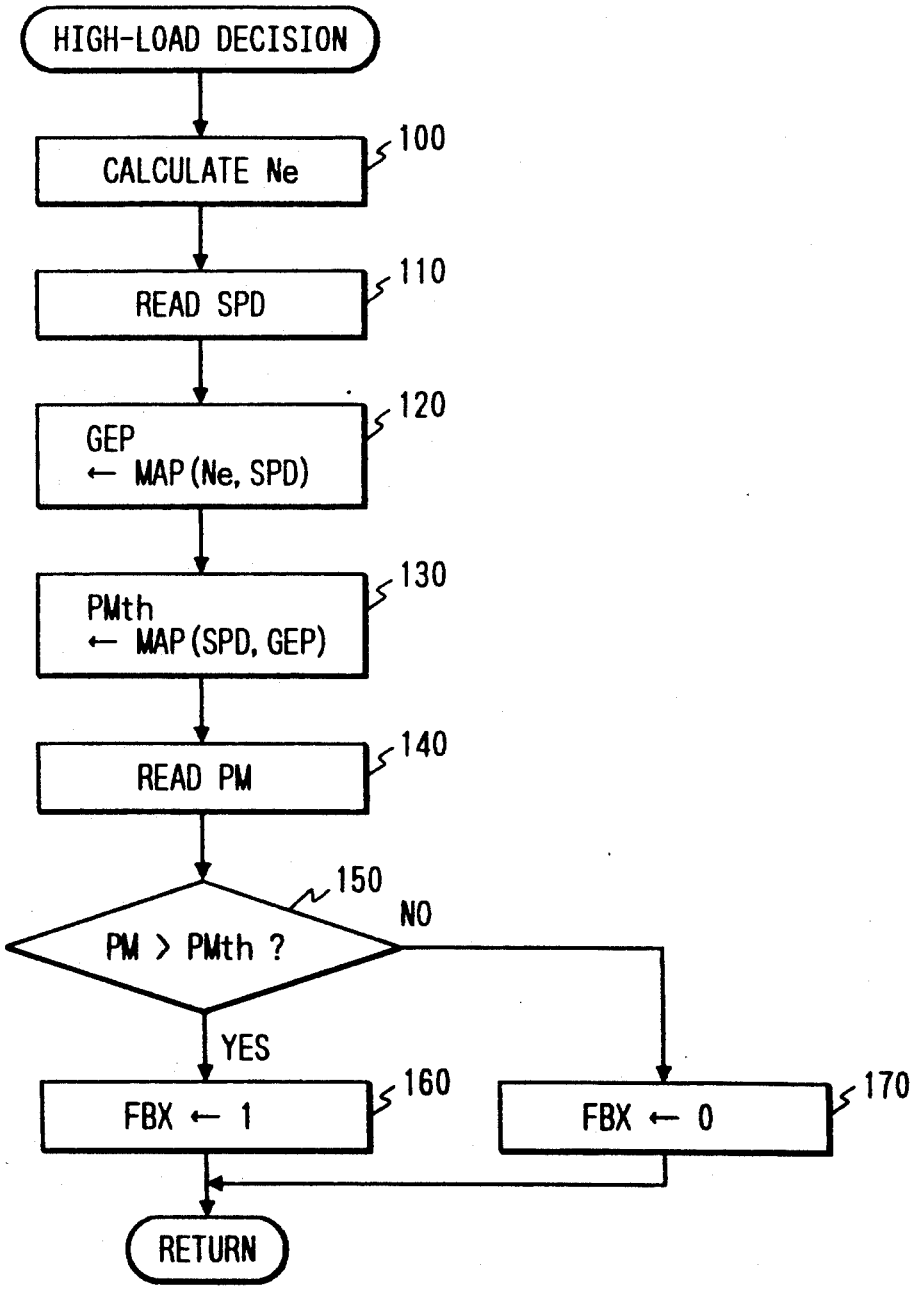
FIG. 2 is a flow chart for describing a decision operation for deciding that an internal combustion engine is in a high-load state.
Figure 3:
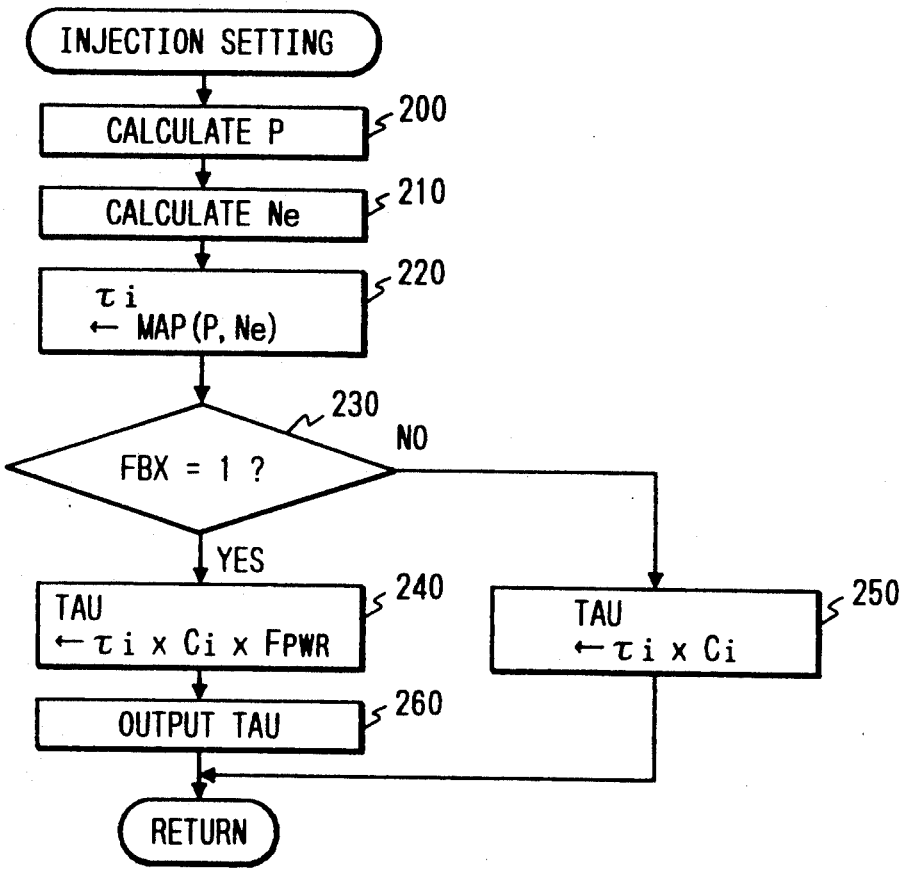
FIG. 3 is a flow chart for describing a fuel supply increasing operation.
Figure 4:
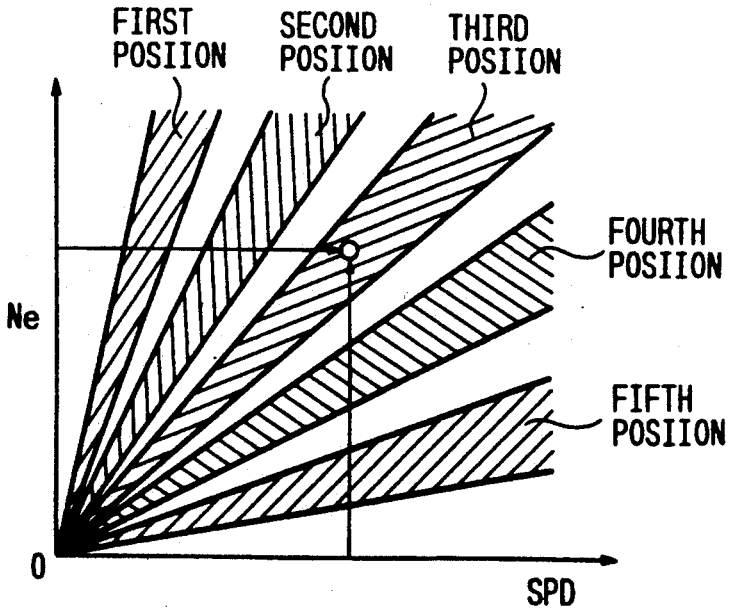
FIG. 4 is a two-dimensional map to be used for the high-load decision operation.

Secondly, a description will be made hereinbelow with reference to FIGS. 2 and 3 in terms of an operation for increasing the fuel injection quantity when the engine 1 is in a high-load state. FIG. 2 shows a routine for deciding whether or not the engine 1 is in the high-load state. In FIG. 2, this routine starts with a step 100 to calculate the engine speed Ne on the basis of the detection signal from the rotational angle sensor 5, then followed by a step 110 to read the vehicle speed SPD on the basis of the detection signal from the vehicle speed sensor 7. Then, a step 120 follows to obtain the gear-shift position GEP in the transmission of the motor vehicle on the basis of the engine speed Ne and the vehicle speed SPD obtained in the aforementioned steps 100 and 110. Here, for example, as illustrated in FIG. 4, the gear-shifted position GEP is obtained using a two-dimensional map of SDP-Ne prestored in the ROM 8*b*. In the two-dimensional map of FIG. 4, each of the gear-shift positions GEP is set to have a range with respect to the parameters (SPD) and Ne) because the wheel slips in accordance with the road surface state. Moreover, in order for preventing a gear-shift position decision error in the case that the gear-shift position GEP is the neutral position, the gear-shift positions are respectively arranged to be separated by predetermined degrees from each other. Here, it is also appropriate that a gear position sensor is provided to obtain the gear-shift position information GEP.

Figure 5:
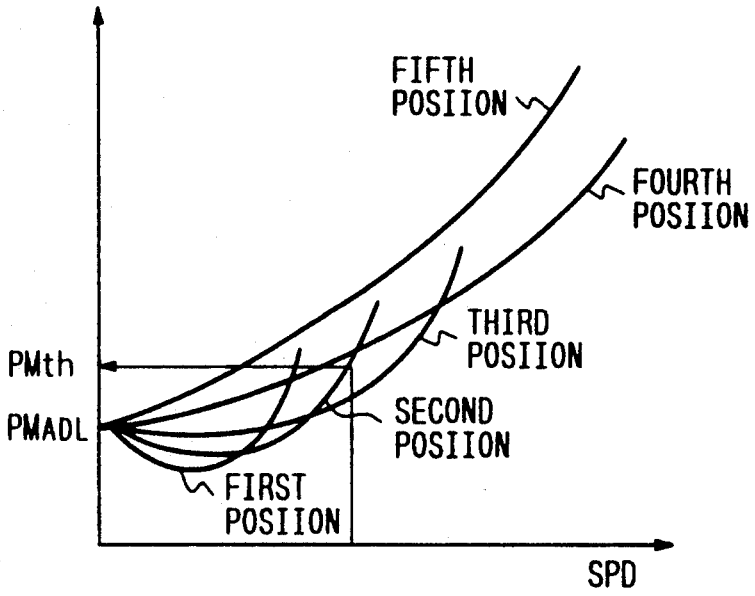
FIG. 5 is a two-dimensional map to be used for the high-load decision operation.

In a subsequent step 130, a decision value PMth for deciding whether the engine 1 is the high-load state is set on the basis of the vehicle speed SPD and the gear-shift position GEP in accordance with a two-dimensional map as illustrated in FIG. 5. Here, the two-dimensional map of FIG. 5 is produced on the basis of the intake pressure values relative to the vehicle speeds SPD when the motor vehicle is running at lowlands (0 m above the sea level) in the steady state. Further, in the case that the vehicle speed SPD is near zero, the decision value PMth in each of the gear-shifted positions is set to be a value of the intake pipe pressure $PM_{ADL}$ to be taken when the engine 1 is in the idling state.

In a step 140 the current intake pipe pressure PM of the engine 1 is read on the basis of the detection signal from the intake pipe pressure sensor 4, and in a step 150 the decision value PMth obtained in the step 130 is compared with the intake pipe pressure PM read in the step 140. When the intake pipe pressure PM is greater than the decision value PMth, the decision is made such that the engine 1 is in the high-load state, thereby advancing to a step 160. On the other hand, when PM is not greater than PMth, the decision is made such that the engine 1 is not in the high-load state, thereby proceeding to a step 170. The step 160 is for setting a fuel increasing flag FBX for performing the process to increase the fuel injection by a predetermined quantity in a fuel injection quantity determining routine. After the execution of the step 160, the operational flow returns to a main routine. Further, the step 170 is for resetting the fuel increasing flag FBX. After the execution of the step 170, the operational flow also returns to the main routine.

Here, although for the high-load decision the intake pipe pressure PM is compared with the decision value PMth, it is appropriate that for the high-load decision the intake pipe pressure PM is compared with a value ($PMth+\alpha$) obtained by adding a predetermined value $\alpha$ (for example, $\alpha=150$ mmHg) to the decision value PMth obtained in accordance with the FIG. 5 two-dimensional map. For example, in the case that the motor vehicle goes up a slope having a small inclination, the motor vehicle can sufficiently run with the normal fuel supply quantity, and hence, with the decision value being increased by the predetermined value $\alpha$, it is possible that the fuel supply quantity is controlled in the fuel injection quantity setting routine (which will be described hereinafter) so as not to be increased in that case.

Further, a description will be made with reference to FIG. 3 in terms of an operation for determining the fuel injection quantity. The FIG. 3 routine is effected at every predetermined rotational angle. In FIG. 3, this operation starts with a step 200 to read the intake pressure P on the basis of the information from the pressure sensor 4 provided in relation to the intake pipe 2, then followed by a step 210 to calculate the engine speed Ne on the basis of the detection signal from the rotational angle sensor 5. The next step 220 is further executed to set the basic injection time (basic injection quantity) $\tau_i$ on the basis of the intake pressure P and the engine speed Ne in accordance with a two-dimensional map previously produced and stored in the ROM 8*b*. In a step 230 it is checked whether the fuel increasing flag FBX is set. If the answer of the step 230 is "YES", the operational flow goes to a step 240, and if the answer of the step 230 is "NO", the operational flow goes to a step 250.

In the step 240 the fuel injection quantity TAU is calculated in accordance with the following equation.

$$TAU=\tau_i\times C_i\times F_{PWR}$$

where Ci is a correction coefficient to be determined in accordance with the temperature of the engine cooling water, the temperature of the intake air or others, and $F_{PWR}$ is a correction coefficient for increasing the fuel injection quantity under the decision that the engine 1 is the high-load region.

In the step 250 the fuel injection quantity TAU is calculated in accordance with the following equation.

$$TAU = \tau_i \times C_i$$

In a step 260 there is outputted a control signal corresponding to the fuel injection quantity TAU calculated in the step 240 or 250 to output it to the engine 1.

Accordingly, as described above, the decision value PMth is set on the basis of the vehicle speed SPD and the gear-shift position GEP, without using a throttle sensor, so as to be compared with the intake pipe pressure PM, thereby accurately performing the high-load decision. In addition, when the decision is made such that the engine is in the high-load state, the fuel injection quantity TAU to the engine 1 is increased so as to obtain a large output at the time of the high-load state, whereby the motor vehicle can effectively run.

Here, although the fuel injection quantity is increased up to predetermined times ($F_{PWR}$) when being in the high-load state, it is appropriate that the deviation (PM−PMth) between the intake pipe pressure PM and the decision value PMth is calculated so that the correction coefficient $F_{PWR}$ is switched in accordance with the deviation (PM−PMth) therebetween, that is, so that the increasing degree of the fuel injection quantity becomes greater as the deviation (PM−PMth) is greater. Further, it is also appropriate that the correction coefficient $F_{PWR}$ is switched so as to gradually reduce the increasing degree of the fuel injection quantity in accordance with the time elapsed from the start of the execution. With such control, it is possible to accurately set the increasing rate of the fuel injection quantity in accordance with the load state of the engine 1 concurrently with preventing the deterioration of the fuel consumption.

Figure 6:
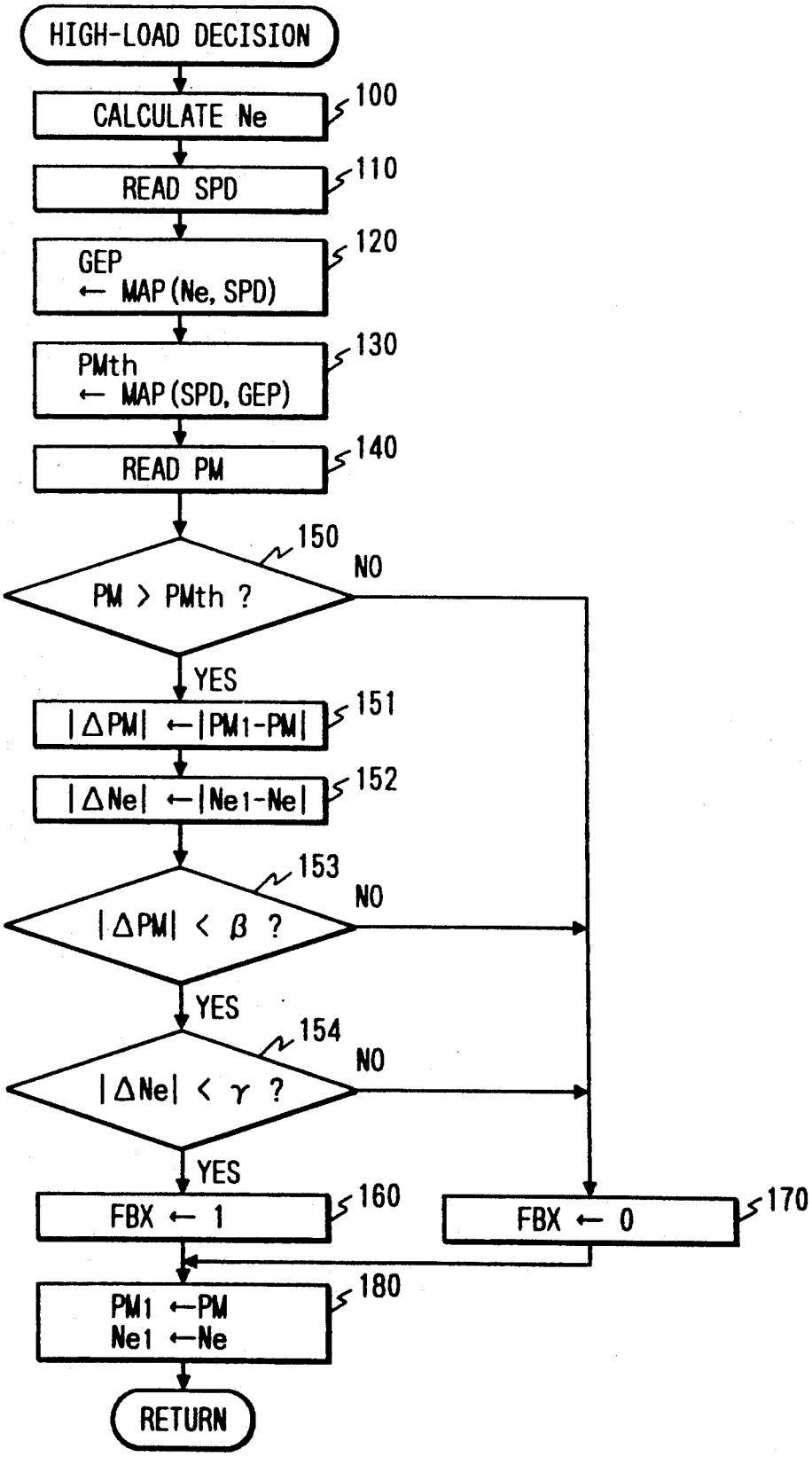
FIG. 6 is a flow chart for describing a high-load decision operation according to a second embodiment of this invention.

Furthermore, a description will be made hereinbelow with reference to FIG. 6 in terms of another embodiment for deciding whether the engine 1 is in the high-load state which requires the increase in the fuel injection quantity. FIG. 6 is a flow chart for deciding whether the engine 1 is a high-load region, where steps corresponding to those in FIG. 2 are marked with the same numerals and the description thereof will be omitted for brevity. One difference between this routine and the FIG. 2 routine relates to the condition for deciding whether the engine 1 is in a state that the increase in the fuel injection quantity is required, that is, the condition for deciding whether the fuel increasing flag FBX is set or not.

In a step 151, an intake pipe pressure variation ΔPM is obtained on the basis of the deviation between the previous intake pipe pressure $PM_1$ and the current intake pipe pressure PM, and in a step 152 an engine speed variation ΔNe is obtained on the basis of the deviation between the previous engine speed $Ne_1$ and the current engine speed Ne. Thereafter, in a step 153 the intake pipe pressure variation ΔPM is compared with a predetermined value $\beta$. If the intake pipe pressure variation ΔPM is smaller than the predetermined value $\beta$, the operational flow advances to a step 154, and if being greater than the predetermined value $\beta$, the operational flow goes to a step 170. In the step 154 the engine speed variation ΔNe is compared with a predetermined value $\gamma$. If the engine speed variation ΔNe is smaller than the predetermined value $\gamma$, the operation advances to a step 160, and if being greater than the predetermined value $\gamma$, the operation goes to the step 170. After the execution of the step 160 or 170, a step 180 follows to store, in the RAM 8c, the present calculated intake pipe pressure PM and engine speed Ne as the previous intake pipe pressure $PM_1$ and engine speed $Ne_1$. Thereafter, in the fuel injection quantity setting routine illustrated in FIG. 3, the fuel increasing flag FBX is detected. If the flag FBX is set, the fuel injection quantity increased is set.

That is, since the decision process of the steps 153 and 154 are additionally effected, for example, even if the acceleration pedal is rapidly depressed to accelerate the motor vehicle for a short time when the motor vehicle is running in a city area, it is possible to prevent increase in the fuel injection quantity under the error decision that the engine 1 is in a high-load region. This can prevent the deterioration of the fuel consumption and the increase in hazardous components of the exhaust gas due to the air fuel ratio being shifted to the rich side.

Figure 8:
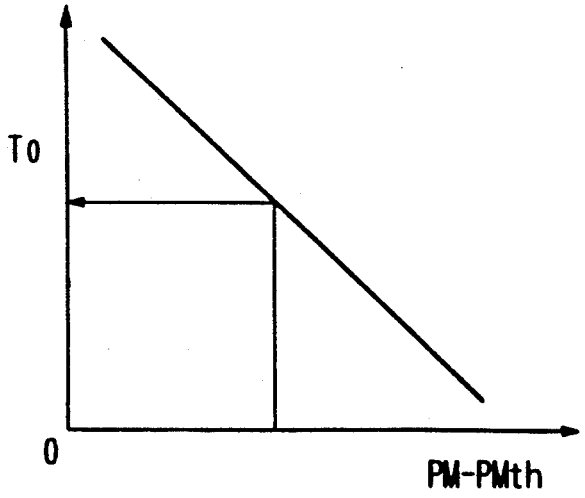
FIG. 8 is a two-dimensional map to be used in the high-load decision operation of the third embodiment.
Figure 7:
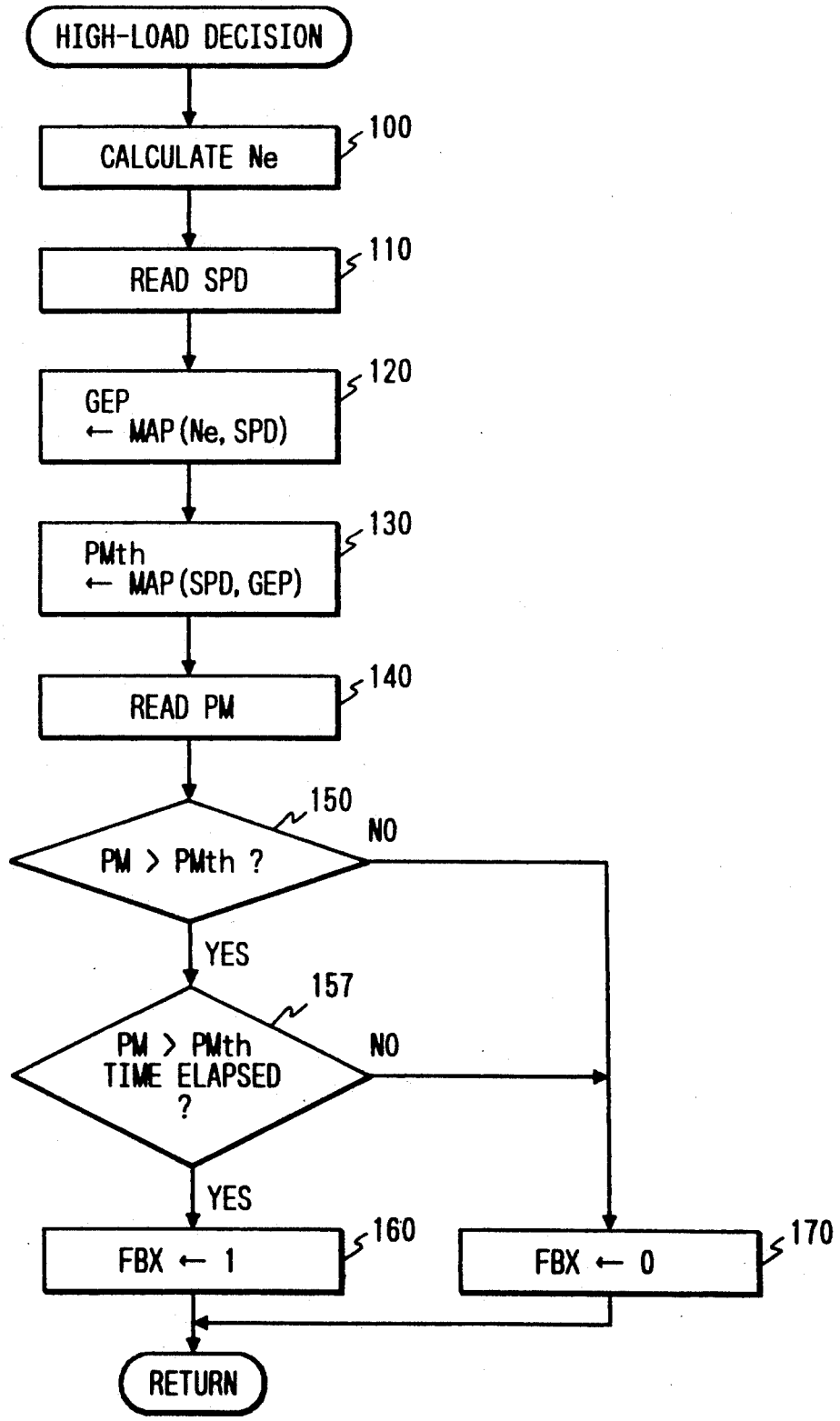
FIG. 7 is a flow chart for describing a high-load decision operation according to a third embodiment of this invention.

In addition, for deciding whether or not the engine 1 is in the high-load region, it is appropriate to add a further decision condition. FIG. 7 shows a flow chart showing a high-load decision operation in this case. In FIG. 7, steps corresponding to those in FIG. 2 are marked with the same numerals and the description thereof will be omitted for simplification. One difference between this routine and the FIG. 2 routine is that a step 157 is added for calculating the time Ta for which the intake pipe pressure PM is greater than the decision value PMth. If the time Ta is longer than a predetermined time To, the step 160 is executed to set the fuel increasing flag FBX. Further, the predetermined time To is switched or changed in accordance with the deviation (PM−PMth) between the intake pipe pressure PM and the decision value PMth as shown in FIG. 8. More specifically, the predetermined time To is set to be smaller as the deviation (PM−PMth) is greater.

According to the present invention, when the intake pipe pressure detected by the intake pipe pressure detecting means is greater than the pressure decision value set on the basis of the vehicle speed and the gear-shifted state at the time of the detection of the intake pipe pressure, the decision is made such that the engine is in a high-load state and the fuel supply quantity is increased in accordance with the high-load decision. This arrangement can accurately detect the high-load state of the engine so as to allow the effective running of the motor vehicle.

Further, in this invention, it is also appropriate to read as the atmospheric pressure the detection result of the intake pipe pressure sensor, obtained when the engine is in a high-load state, so as to use this detection result for the fuel supply control.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A fuel supply control apparatus for an internal combustion engine on a motor vehicle, comprising:

means for detecting a speed of said motor vehicle;

means for detecting a rotational speed of said engine;

means for detecting a gear-shift state in a transmission of said engine;

means for detecting a pressure within an intake pipe of said engine;

means for setting an intake pipe pressure decision value on the basis of the detection result of said vehicle speed detecting means and the detection result of said gear-shift state detecting means at the time of the detection of the intake pipe pressure;

means for comparing the detection result of said intake pipe pressure detecting means with the setting result of said pressure decision value setting means to decide that said engine is in a high-load state when the detection result of said intake pipe pressure detecting means is greater than the setting result of said pressure decision value setting means; and means for increasing a fuel injection quantity to said engine when said high-load decision means decides that said engine is in said high-load state.

2. An apparatus as claimed in claim 1, wherein said high-load decision means decides said high-load state of said engine when at least one of a variation of said intake pipe pressure, a variation of said engine speed and a variation of said vehicle speed becomes below a predetermined value and further the detection result of said intake pipe pressure detecting means is greater than the setting result of said pressure decision value setting means.

3. An apparatus as claimed in claim 1, wherein said high-load decision means decides said high-load state of said engine when the detection result of said intake pipe pressure detecting means is greater than the setting result of said pressure decision value setting means for longer than a predetermined time.

4. An apparatus as claimed in claim 1, wherein said gear-shift state detecting means detects said gear-shift state in said transmission of said engine on the basis of the detection results of said vehicle speed detecting means and said engine speed detecting means.

5. An apparatus as claimed in claim 1, further comprising means coupled to said intake pipe pressure detecting means for reading the detection result of said intake pipe pressure detecting means as an atmospheric pressure when said high-load decision means decides that said engine is in said high-load state.

6. An apparatus as claimed in claim 3, wherein said predetermined time is changed in accordance with a deviation between the detection result of said intake pipe pressure detecting means and the setting result of said pressure decision value setting means.

* * * * *